US006211615B1

(12) United States Patent
Altmann et al.

(10) Patent No.: US 6,211,615 B1
(45) Date of Patent: Apr. 3, 2001

(54) POWDER METAL ELECTRODE COMPONENT FOR DISCHARGE LAMPS

(75) Inventors: Bernhard Altmann, Langeringen; Alfred Gahn, Koenigsbrunn; Dietmar Illig, Augsburg; Peter Schade, Schwabmuenchen, all of (DE)

(73) Assignee: Patent-Truehand-Gesellshaft fuer Elektrische Gluelampen mbH, Munich (DE)

( * ) Notice: Subject to any disclaimer, the term of this patent is extended or adjusted under 35 U.S.C. 154(b) by 0 days.

(21) Appl. No.: 09/149,419

(22) Filed: Sep. 8, 1998

(30) Foreign Application Priority Data

Nov. 11, 1997 (DE) ..... 197 49 908

(51) Int. Cl.[7] ..... H01J 17/04; H01J 61/04
(52) U.S. Cl. ..... 313/631; 313/633; 313/491
(58) Field of Search ..... 313/631, 346 R, 313/311, 633, 491; 419/12, 19, 20

(56) References Cited

U.S. PATENT DOCUMENTS

| | | | |
|---|---|---|---|
| 3,248,586 | 4/1966 | Schlegel | 313/37 |
| 3,248,591 | 4/1966 | Arndt | 313/217 |
| 3,303,377 | 2/1967 | Jansen et al. | 313/184 |
| 3,621,322 | 11/1971 | Rehmet et al. | 313/211 |
| 3,911,309 | 10/1975 | Kümmel et al. | 312/346 R |
| 4,113,480 | 9/1978 | Rivers | 75/214 |
| 4,479,074 * | 10/1984 | Bhalla | 313/628 |
| 4,765,950 | 8/1988 | Johnson | 419/2 |
| 5,033,939 | 7/1991 | Brasel | 419/37 |
| 5,210,463 | 5/1993 | Fromm et al. | 313/631 |
| 5,304,892 | 4/1994 | Lewandowski et al. | 3112/623 |
| 5,774,780 * | 6/1998 | Prause | 419/412 |

FOREIGN PATENT DOCUMENTS

| | | | |
|---|---|---|---|
| 19626624 | 2/1998 | (DE) | H01J/61/073 |
| 2034106 | 5/1980 | (GB) | H01J/1/14 |
| 1161653 | 6/1989 | (JP) | H01J/61/073 |

OTHER PUBLICATIONS

Electrodenwerkstoffe Afur der . . . pp. 182–191 (1976).
Metallspritzguss—Wirtschaftlich . . . pp. 118–120.
European Powder Metallurgy Association. 12 pgs & 4 pgs.
Vervoort et al., "Overview of Powder Injection Molding"; Advance Performance Materials (1996) pp. 121–151.
Eifert, et al, "Metallspritzguss—Wirtschaftlich . . . " M&T Metallhandwerk & Technik, (Sep. 1994), pp. 118–120.

* cited by examiner

*Primary Examiner*—Nimeshkumar D. Patel
*Assistant Examiner*—Joseph Williams
(74) *Attorney, Agent, or Firm*—William H. McNeill

(57) ABSTRACT

The electrode component according to the invention is produced by means of the metal powder injection molding method. As a result, complex shapes can be realized for the electrode.

10 Claims, 4 Drawing Sheets

POWDER METAL ELECTRODE COMPONENT FOR DISCHARGE LAMPS

TECHNICAL FIELD

This invention relates to an electrode component for discharge lamps. More particularly, it relates to electrode components formed from high temperature resistant metals or carbides of such metals. Still more particularly, it relates to such electrode components produced by metal powder injection moulding. This can concern, in particular, electrodes for high-pressure discharge lamps such as are used, for example, for photooptical purposes. However, on the other hand the invention can also be used for individual parts of electrodes, or also for frame parts holding the electrode, for example shaft parts for electrodes. Said parts are subsumed below under the term of components for electrodes.

PRIOR ART

In lamp construction, electrodes and components for electrodes are normally manufactured from a high-melting metal such as tungsten or molybdenum or also tantalum. In this case, the electrode is virtually always solid, that is to say it has been produced using powder metallurgy and shaped with the aid of rolling, hammering and drawing processes. Because of the high costs, the application of a sintered body has so far been unable to become established.

Solid electrodes have the disadvantage that complicated electrode shapes such as, for example, would be required for optimum thermal shaping cannot be produced with such known electrode structures, or can be produced only with a great deal of metal cutting effort, and therefore with a high level of extra consumption (up to more than 50% waste).

For specific purposes, known electrodes are also assembled from two components.

They are frequently denoted as combination electrodes or insert electrodes. The document "Elektrodenwerkstoffe auf der Basis hochschmelzender Metalle" ("Electrode materials based on high-melting metals"), publisher VEB Narva, Berlin, 1976, pages 183 to 189 has already disclosed electrodes which comprise two components. Examples described there are anodes in FIG. 55*a* and cathodes in FIGS. 56*c, d*, for xenon short-arc lamps in each case. Said electrodes comprise a conventional sintered body (radiator) made from tungsten, which serves as a heat-balancing element. On the discharge side, a solid insert made from hammered tungsten is fastened in a cavity of the radiator. Said insert is doped with an emitter, which is frequently radioactive. A supply lead in the form of a tungsten pin is sintered into a bore in the radiator by means of a filament.

A similar technique is also described in DE-A 196 26 624. However, the insert is dispensed with in the latter instance. The production of such bipartite electrodes is very time-consuming and has so far not been capable of automation.

Such electrodes are therefore also scarcely used, because the complicated processing of the heat-balancing element, specifically the production of a receptacle for inserting an insert, is uneconomical and laborious.

Electrodes with an emitter additive (mostly oxides of thorium, the alkaline earth metals or the rare earth metals, in particular lanthanum) are required for special applications. However, the known production methods described above each require a very high degree of mechanical processing. With increasing emitter content, however, the property of deformability required for processing becomes limited. Consequently, it has so far not been desired to set the emitter content relatively high (approximately 3–5%). Instead of this, it has so far been necessary to make do with complicated structures in order nevertheless to realize a high emitter content. For example, it is known to use a filament pushed onto the electrode, an emitter-containing paste being inserted into the cavities between the individual turns of the filament.

SUMMARY OF THE INVENTION

It is the object of the present invention to provide an electrode component which eliminates the disadvantages discussed above.

Another object of the invention is the provision of a method of making complicated shapes of electrode components.

Moreover, it is yet another object of the invention to improve the microstructural stability of an electrode in the thermally highly loaded region at the tip of the electrode is to be improved.

Finally, there is the aim of a higher loadability with regard to the current intensity, as well as a better thermal loadability and also a higher luminous density. Conventional techniques can no longer provide improvement here, and this is to be seen as disadvantageous chiefly in the case of high-power lamp types of over 300 W. It is also desired to improve the arc instability and to increase the service life.

These objects are achieved, in one aspect of the invention, by the provision of an electrode component for discharge lamps, produced from high-temperature resistant metal, in particular from tungsten, molybdenum, tantalum, rhenium or alloys and also carbides of said materials, characterized in that the electrode component is produced using the metal powder injection moulding method.

According to the invention, the electrode components are produced by a metal powder injection moulding method. This technique, better known under the English acronym of MIM (Metal Injection Moulding) has been known per se for a long time. However, it has never been used in lamp construction.

A brief overview of the metal powder injection moulding method (MIM) is to be found in the article "Metallspritzguß—wirtschaftlich für komplizierte Bauteile" ("Metal injection moulding—economical for complicated components") in: Metallhandwerk & Technik 1994, pages 118 to 120, as well as in the advertising brochure entitled "Metal Injection Molding" of the European Powder Metallurgy Association, Shrewsbury (UK). A good overview is also to be found in the article entitled "Overview of Powder Injection Molding" by P. J. Vervoort et al., in: Advanced Performance Materials 3, pages 121–151 (1996).

The metal powder injection moulding method (see, for example, U.S. Pat. No. 4,765,950 and U.S. Pat. No. 4,113,480) combines the freedom of shaping in the known plastic injection moulding with the wide-ranging materials possibilities of powder metallurgy. This renders possible the direct production of components of very complicated shape in near net shaping while avoiding metal-cutting finishing. Moreover, it is now possible to automate the production method.

The cycle of the method can be summarized briefly as follows: a suitable metal powder is mixed with so much plastic (the so-called binder) that said mixture, which is present as a granulate, assumes the flow properties of the plastic and can be further processed in a fashion similar to plastic injection moulding by inserting it into an injection mould having the contour of the desired future component. In order then to obtain a metal component, the green body is removed from the injection mould; the binder is subsequently removed from the so-called green body by heat or by solvents. This operation is denoted as dewaxing. After that, the component is sintered in accordance with classic powder metallurgy to form a component of very high density (at least 90% by volume, preferably 95% and more). The residual porosity of at most 10% or 5% is preferably to be present as closed pores.

It is important in the metal powder injection moulding method to avoid chemical reactions between the organic binder (see, for example, U.S. Pat. No. 5,033,939) and the actual material, as well as to remove the binder in a careful and gentle way from the injection-moulded body (see, for example, U.S. Pat. No. 4,534,936).

The sintering activity of the metal powder used must also be sufficiently high in order to achieve a high sinter density. Consequently, very fine metal powders with low mean grain sizes (below 20 $\mu$m, preferably below 2 $\mu$m) are used.

According to the invention, electrode components for discharge lamps are produced from high-temperature resistant metal. Particularly suitable are tungsten, molybdenum, tantalum, rhenium, or alloys thereof, but also carbides of said metals, in particular tantalum carbide (TaC).

To date, the further development of lamps with increased luminous densities has encountered narrow limits set by the conventional techniques of electrode production. The electrodes have been produced from blanks with appropriate dimensions by turning, grinding, boring etc. If appropriate, suitable production processes such as rolling and swaging or hammering are used to introduce additional shaping work, in order to increase the microstructural stability of the electrode materials. Serving now as electrode materials are high-temperature resistant metals such as, for example, W, Ta, Mo, Re or their alloys, which are partially additionally doped, in order to increase the microstructural stability of the materials. Doping for the purpose of microstructural stability is preferably performed using elements such as, for example, K, Al and Si and, additionally, with oxides, carbides, borides, nitrides and/or the pure metals (or their alloys) of rare earth elements, of the lanthanoids, of the actinoids such as, for example, La, Ce, Pr, Nd, Eu, Th, but also Sc, Ti, Y, Zr, Hf. They serve not only for the purpose of providing microstructural stability, but also of reducing the electron work function.

In a particularly preferred first embodiment, the metal powder injection moulding method is used to produce unipartite electrodes, in particular made from tungsten, the injection mould being capable of having complex contours. High density bodies with typically 98% (even up to more than 99%) of the theoretical density can be produced which are already near net shaped. This renders it possible, in particular, to optimize the heat flow behaviour of electrodes, in particular by virtue of the fact that the electrode has suitably shaped constrictions (recesses) and grooves or the like. To date, it has been necessary to accept wastage of up to approximately 60% for such electrodes. By contrast, the application of the metal powder injection moulding method permits the wastage to be limited to a few per cent. Moreover, it is now possible to realize optimized shapes which could not previously be produced at all.

In a second embodiment, individual electrode components are used which have been produced by means of metal powder injection moulding methods. This relates to individual parts of electrodes, but also electrode frame parts for holding electrodes, for example electrode shafts, in particular made from molybdenum or tungsten.

In a third embodiment, the electrode component according to the invention is intended for an insert electrode. The insert electrodes comprise several (mostly two) components. An insert is located as the electrode tip in an appropriately shaped radiator according to the invention made from one of the abovementioned materials which serves as heat-balancing element. The radiator consists, in particular, of tungsten. It has a receptacle (cavity) for the insert on its side facing the discharge. It is possible through the application of the metal powder injection moulding method to dispense with a soldered joint between the insert and radiator and, in a particularly preferred fashion, also with a complicated mechanical connection between the radiator and electrode shaft in accordance with the filament technology described above. In this case, it is possible to use as insert a conventional, known solid component such as described at the beginning, whose emitter content is approximately 0.2 to 5% by weight, for example. Moreover, in this embodiment, as well, the radiator can have an optimized shape with respect to the heat flow behaviour (similar to the first embodiment).

The advantage of the solderless joint is, inter alia, that the filling contained in the discharge volume is not polluted. The radiator designed as an injection moulded sintered body shrinks onto the insert or onto the shaft.

For the purpose of reducing the arc instability, the insert is frequently doped with an emitter (use mostly being made of radioactive thorium oxide) in small quantities (see above). When producing the insert, only very little waste which is radioactively loaded occurs, by contrast with the unipartite compact electrode used virtually exclusively to date.

By contrast with known compact electrodes, however, the insert can now have a conspicuously smaller diameter. This renders it possible to exert a far greater influence than heretofore on its microstructure. It is now even possible to achieve virtually the theoretical density of the electrode material. This leads to stabilization of the microstructure, in particular to dimensional stability even in the case of high temperatures. The electrode tip can thus be more highly loaded thermally, and this corresponds to a higher current loading (current carrying capacity)(up to 15%) or a longer service life in conjunction with a very low arc instability. The radiator can consist of the same material as the insert, but it is advantageous here to use the undoped, pure metal, preferably W, Ta, Mo or Re and their alloys.

Automation is rendered possible because of the fact that the shape is prescribed by near net shaping as early as in the production in the case of MIM technology. In addition, during shaping of the heat balancing element virtually no waste occurs in the form of dusts, chips etc., by contrast with conventional production. The latter requires intensive finishing by turning, boring, grinding and the like.

The radiator, which by contrast with the insert is not located in the thermal main load zone, has a density of at least 90% of the theoretical density because of the use of MIM technology. The density is preferably above 95%, corresponding to a residual porosity of <5%. An important property of the body rendered highly dense in such a fashion is that its pores are closed and not interconnected. They therefore have no connection to the surface.

When the radiator is being shaped, it is now possible, moreover, to depart very easily from rotational symmetry by using an appropriate injection mould. An example is an elliptical shape of the radiator. That shape takes account of the emission characteristic in an asymmetric (elliptical) discharge vessel such as is used, for example in order to make allowance for arc lift in the case of a horizontal operating position.

Fixing the insert and the supply lead (electrode shaft) on the radiator can preferably be performed directly without additional aids by shrinking on during the common final sintering of all the components. This eliminates connecting techniques such as welding and soldering, which require appropriate welding and soldering aids. The point is that because the radiator is produced according to the metal injection moulding method, the insert and supply lead can be injection-coated with the granulate of the radiator. Fixing is thus performed even before sintering. In the case that the insert and electrode shaft are selected to be of the same material, they can even be inserted in a continuous fashion as one piece into the injection mould of the radiator, and this lends the electrode particular stability. This is possible in the case of lamps whose insert requires no emitter.

BEST MODE FOR CARRYING OUT THE INVENTION

Figure 1:
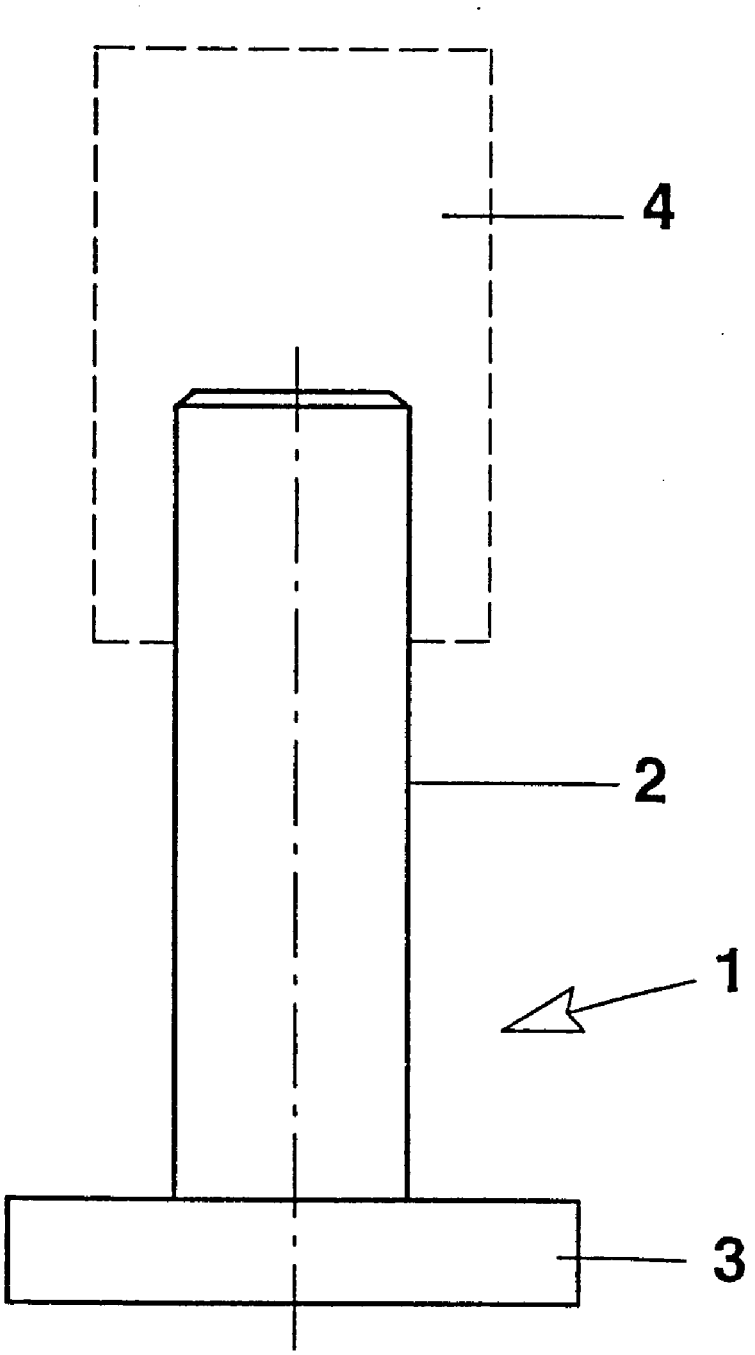
FIG. 1 shows an electrode frame part for a mercury high-pressure lamp.

FIG. 1 shows a frame part 1 for holding a conventional cylindrical electrode 4 (indicated by dashes), for example for a mercury high-pressure lamp. It comprises a bar-shaped shaft 2 to whose end remote from the discharge an annular component 3 (so-called plate) is attached in one piece. Lamps of such construction are described, for example, in EP-B 479 089 (to which U.S. Pat. No. 5,304,892 corresponds). The frame part 1 is produced as a unit made from tungsten or molybdenum using the metal powder injection moulding method. To date, it has been necessary for said frame part to be assembled from two solid individual parts and then laboriously soldered with platinum. This harbours the risk of breakage at the seam. The only alternative to date has been expensive turning from a solid blank, in which case a great deal of waste has had to be accepted.

Figure 2:
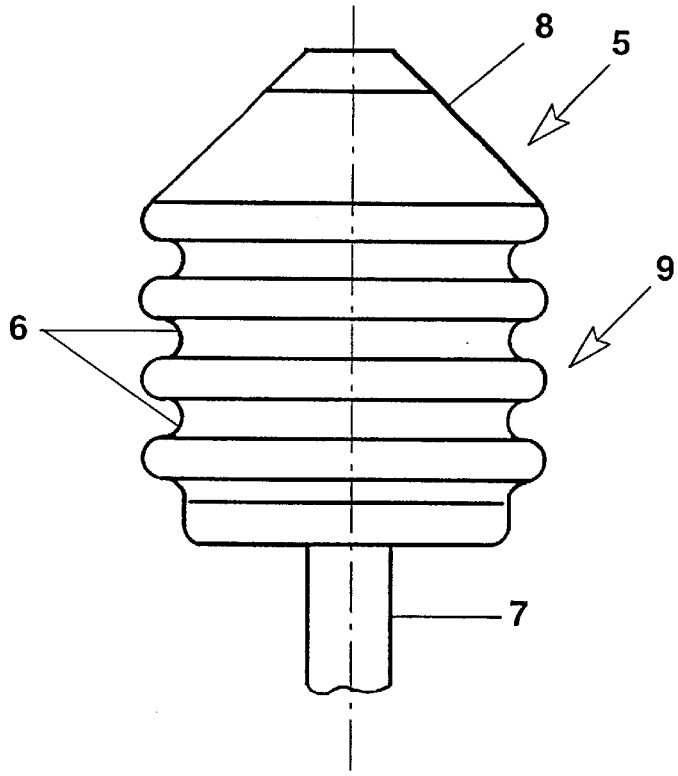
FIG. 2 shows an electrode with an optimized heat flow behaviour for a highly loaded high-pressure discharge lamp.

A unipartite electrode 5 for a highly loaded high-pressure discharge lamp is shown in FIG. 2. It comprises a cylindrical basic element 9 and a conical stump 8 attached on the discharge side. In order to optimize the heat flow, the basic element 9 has a series of circumferential grooves 6 which ensure that the temperature at the shaft 7 is relatively low. Such electrodes can now be tailored for xenon short-arc lamps, mercury high-pressure lamps, metal halide lamps and sodium high-pressure lamps. The shape of the electrode, optimized for heat flow, can be tuned exactly to the requirements of the respective type of lamp by using MIM technology.

Figure 3:
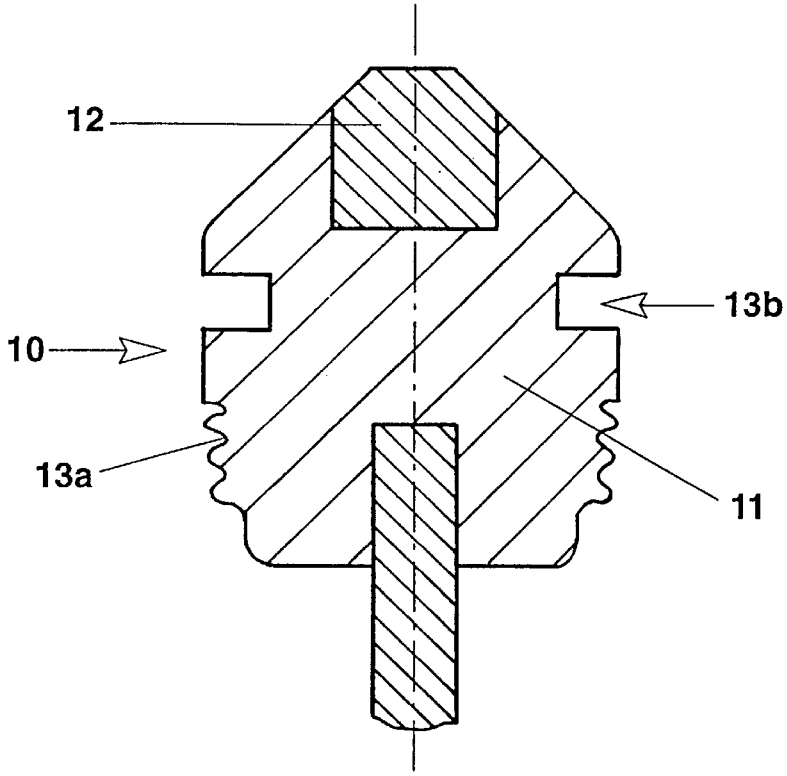
FIG. 3 shows an insert electrode.

An insert electrode 10 is shown in FIG. 3. It comprises a radiator 11 produced from tungsten using MIM technology and has a cavity on the side facing the discharge, into which a solid insert 12 is inserted in a solderless fashion. The insert 12 consists of tungsten with a fraction of 2% by weight of $ThO_2$. In order to optimize the heat flow, the radiator 11 has circumferential grooves 13*a* relatively far back on the side averted from the discharge, and a circumferential recess 13*b* in the front region. The insert electrode 10 has the following dimensions: the outside diameter amounts to 10 mm, and the length is 18 mm.

Figure 4:
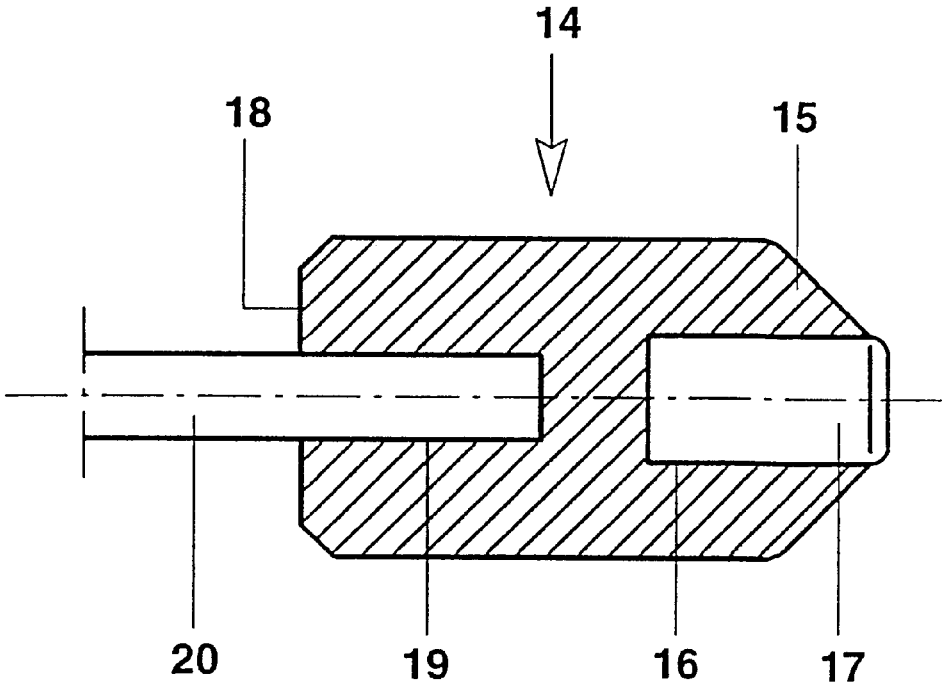
FIG. 4 shows an anode which is designed as an insert electrode.

An anode 14 for xenon short-arc lamps is shown in FIG. 4. It comprises a radiator 15, which is produced as an MIM component, that is to say using the metal powder injection moulding method, and is designed in the form of a cylindrical tungsten member with a tip on the discharge side. It has in the region of the tip a cavity 16 into which an emitter-containing insert 17 is inserted in a solderless fashion. It has on its side 18 remote from the discharge a bore 19 into which an electrode shaft 20 made from solid tungsten is inserted. The anode 14 has the following dimensions: the outside diameter amounts to 20 mm, and the length is 35 mm.

Figure 5:
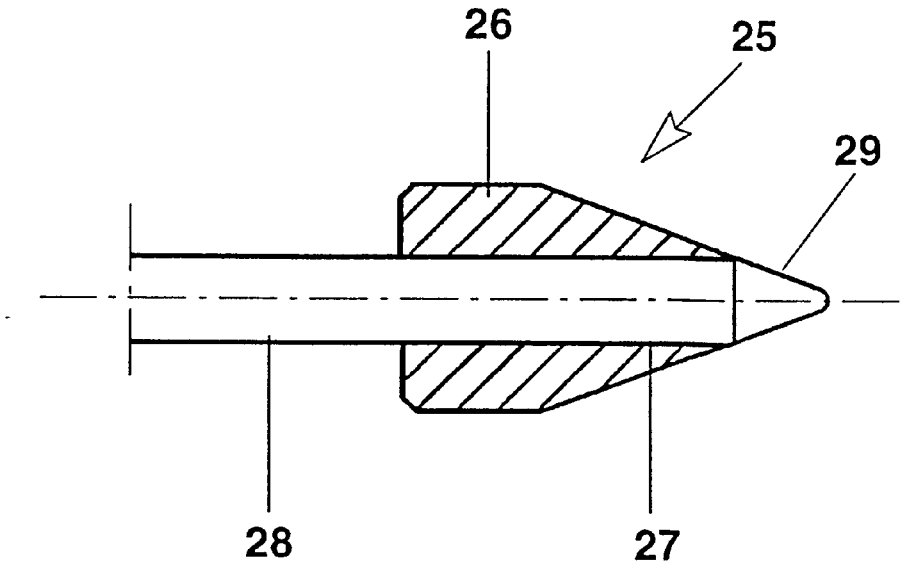
FIG. 5 shows a cathode which is designed as an insert electrode.

A bipartite cathode 25 for a xenon short-arc lamp is shown in FIG. 5 as a substitute for a filament electrode. Said cathode is much more delicately designed than the anode. A radiator 26, which is produced by means of the metal powder injection moulding method from doped, emitter-containing tungsten, comes to a tip conically at the front. It has a continuous bore 27 into which a shaft 28 is inserted in a solderless fashion. An insert 29 projects beyond the radiator 26 on the discharge side. The insert 29 and shaft 28 are produced continuously from one piece (solid undoped tungsten). Said unipartite component is inserted into the injection mould for the radiator before the granulate for the radiator is injected. Said cathode manages in this way without any fastening means (solder or filament). The cathode 25 has the following dimensions: the outside diameter amounts to 2.5 mm, and the length is 3 mm.

Figure 6:
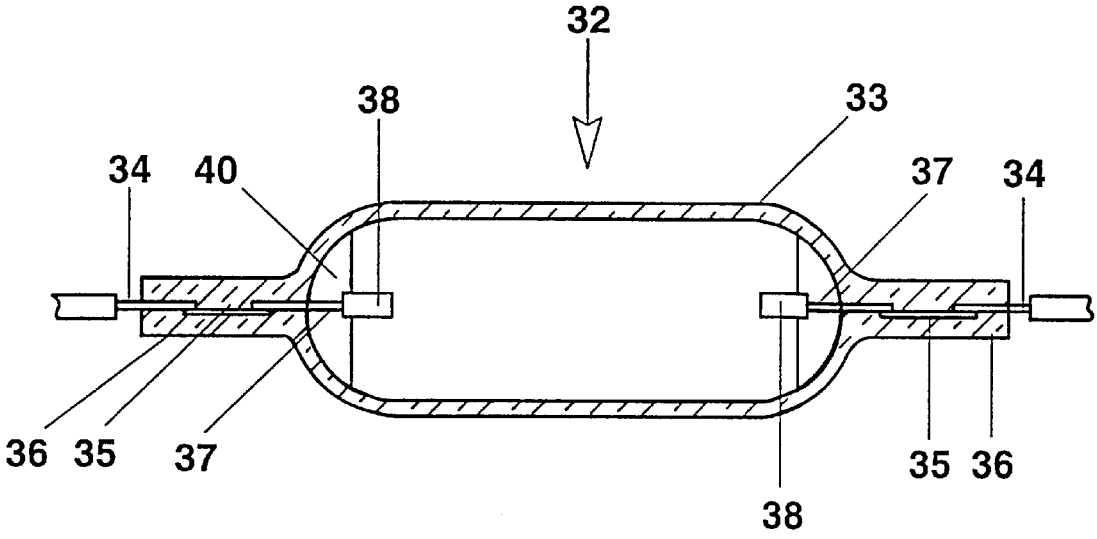
FIG. 6 shows a lamp with an electrode according to the invention.

A metal halide lamp 32 with a power of 150 W is shown in FIG. 6 as an application example. It comprises a silica glass vessel 33 which contains a metal halide filling. External supply leads 34 and molybdenum foils 35 are embedded at its two ends in pinches 36. Fastened to the molybdenum foils 35 are the shafts 37 of cylindrical electrodes 38 produced by means of the metal powder injection moulding method. Said electrodes project into the discharge vessel 32. The two ends of the discharge vessel are provided in each case with a heat-reflecting coating 40 made from zirconium oxide.

What is claimed is:

1. An electrode component for high pressure discharge lamps, produced from high-temperature resistant powder metal, in particular from tungsten, molybdenum, tantalum, rhenium or alloys and also carbides of said materials, characterized in that the electrode component is produced using a metal powder injection moulding method and said powder metal has a mean grain size below 20 $\mu$m.

2. The electrode component according to claim 1, characterized in that the density of the electrode component is at least 90% of the theoretical density, preferably at least 95% of the theoretical density.

3. The electrode component according to claim 2, characterized in that the residual porosity is closed.

4. The electrode component according to claim 1, characterized in that the electrode component is an electrode frame part (1), in particular made from molybdenum or tungsten.

5. The electrode component according to claim 1, characterized in that the electrode component is an electrode (5), particularly made from tungsten, which is unipartite and shaped such that its heat flow behaviour is optimized.

6. The electrode component according to claim 5, characterized in that the electrode (5) has circumferential grooves (13*a*) and recesses (13*b*).

7. Electrode component according to claim 1, characterized in that the electrode component is a radiator (11), in particular made from tungsten, which has on the side facing the discharge a cavity into which an insert (12) is inserted.

8. The electrode component according to claim 1, characterized in that the electrode component is a multipartite electrode (14;15) in which at least one of the individual parts is produced in accordance with the metal powder injection moulding method.

9. The electrode component according to claim 8, characterized in that the individual part produced by means of the metal powder injection moulding method is connected to at least one of the other parts without solder.

10. The electrode component according to claim 8, characterized in that the individual part (26) produced by means of the metal powder injection moulding method surrounds a shaft (28) and an insert (29), the shaft and insert comprising a single part.

* * * * *